US006693514B2

(12) United States Patent
Perea, Jr. et al.

(10) Patent No.: US 6,693,514 B2
(45) Date of Patent: Feb. 17, 2004

(54) SIGNALING DEVICE FOR ANNUNCIATING A STATUS OF A MONITORED PERSON OR OBJECT

(75) Inventors: Levi J. Perea, Jr., Chicago, IL (US); Steven J. Grabowski, Chicago, IL (US); Michael C. Perkins, Rolling Meadows, IL (US)

(73) Assignee: Rauland-Borg Corporation, Skokie, IL (US)

( * ) Notice: Subject to any disclaimer, the term of this patent is extended or adjusted under 35 U.S.C. 154(b) by 50 days.

(21) Appl. No.: 10/102,219

(22) Filed: Mar. 20, 2002

(65) Prior Publication Data

US 2003/0179099 A1 Sep. 25, 2003

(51) Int. Cl.[7] ..... H05B 41/00

(52) U.S. Cl. ..... 340/332; 340/691.4; 340/286.07; 362/215; 362/225; 362/236

(58) Field of Search ..... 340/815.45, 691.1, 340/691.3, 691.4, 691.5, 286.07, 321, 322, 331, 332, 384.1; 362/145, 147, 211, 215, 225, 217, 227, 236

(56) References Cited

U.S. PATENT DOCUMENTS

| | | | | |
|---|---|---|---|---|
| 2,934,752 A | * | 4/1960 | Arrasmith | 340/502 |
| 3,868,682 A | * | 2/1975 | Simon et al. | 340/815.76 |
| 4,082,934 A | | 4/1978 | Piber | |
| 4,346,275 A | | 8/1982 | Iwakiri et al. | |
| 4,736,186 A | * | 4/1988 | Jones | 340/331 |
| 4,851,824 A | | 7/1989 | Murata | |

(List continued on next page.)

OTHER PUBLICATIONS

Technical Data Brochure from Agilent Technologies, "T–1 ¾ (5 mm) Precision Optical Performance InGaN Blue and Green LEDs;" copyright 1999.

Technical Data Brochure from Agilent Technologies, "Precision Optical Performance AllnGaP II LED Lamps;" copyright 1999.

Product Catalog from AUSTCO, "CM–Dx Over Door Lamp Series;" Jan. 3, 1999.

Product Brochure from Tech Works™, "Clinic–Call Intelligent Zone Light, Model 5040;".

Product Brochure from Tech Works™, "5123S Duress Alarm Corrido r Light;" Jul. 1999.

*Primary Examiner*—Nina Tong
(74) *Attorney, Agent, or Firm*—Leydig, Voit & Mayer, Ltd.

(57) ABSTRACT

A signaling device for annunciating in a hallway of a building a status of a monitored person or object is provided. The signaling device includes at least two vertically stacked sections for announcing a status of the monitored person or object with each section announcing a status of a different condition. Each section includes a solid-state, light-emitting device (LED) that is supported such that when the device is mounted to the wall of the hallway a beam of light from the LED is substantially aimed at a wall opposing the wall to which the device is mounted. A pair of opposing planar surfaces extends along diverging planes and is supported over each LED to receive the LED's beam of light. Each of the planar surfaces extends at an angle approximately equal to a characteristic optical beam angle of the beam of light. This arrangement causes light from the light beam to substantially uniformly illuminate an entirety of each of the planar surfaces when viewed from an angle approximately perpendicular to a direction in which the beam of light is aimed. Each of the planar surfaces has an area sufficient to be easily viewed at a location in the hallway remote from where the device is mounted such that one planar surface of the pair is easily seen from one end of the hallway and the other planar surface is easily seen from the other end of the hallway. The signaling device further includes a lens for diffusing light reflected from the planar surfaces.

21 Claims, 10 Drawing Sheets

U.S. PATENT DOCUMENTS 4,910,368 A 3/1990 Honda et al.
5,097,258 A 3/1992 Iwaki
5,295,050 A 3/1994 Helstern et al.
5,546,292 A 8/1996 Shemitz
5,621,379 A * 4/1997 Collins ..... 340/332
5,633,623 A 5/1997 Campman
5,684,467 A 11/1997 Hur
5,914,665 A 6/1999 Thorp et al.
5,945,925 A * 8/1999 Budnovitch ..... 340/932.2
5,963,126 A * 10/1999 Karlin et al. ..... 340/321
6,152,762 A * 11/2000 Marshall et al. ..... 439/489
6,215,409 B1 4/2001 Blach
6,249,221 B1 * 6/2001 Reed ..... 340/539.14
6,340,868 B1 * 1/2002 Lys et al. ..... 315/185 S

* cited by examiner

SIGNALING DEVICE FOR ANNUNCIATING A STATUS OF A MONITORED PERSON OR OBJECT

FIELD OF THE INVENTION

This invention pertains to signaling devices, and more particularly to a signaling device for annunciating a status of a monitored person or object.

BACKGROUND OF THE INVENTION

Communication is a very important aspect of health care. Consequently, health care facilities such as hospitals, out-patient clinics and assisted living facilities generally have communication systems that allow patients or residents to summon caregivers. One component of such systems is corridor lights which are situated, for example, outside of each of the patient rooms. These corridor lights provide signals that are indicative of the status or priority of a particular call from the patient housed in the room. For example, the corridor light may be configured to provide different signals for a normal nurse call and an emergency call such as a "code blue" situation.

Many of these corridor lights use conventional incandescent bulbs to provide illumination. These incandescent bulbs are subject to failure when the filament breaks or bums out. Accordingly, the bulbs have to be replaced periodically, creating a maintenance issue. More importantly, because they are used in a health care environment, the reliability of these corridor lights can be a very important consideration. To address this concern, corridor lights used in critical care environments can be equipped with supervisory circuits which monitor the integrity of the filament in, at least, the bulbs corresponding to the most critical calls, such as a "code blue" situation. However, these supervisory circuits are expensive, increasing the overall cost of the corridor light.

BRIEF SUMMARY OF THE INVENTION

The invention provides a signaling device for annunciating in a hallway of a building a status of a monitored person or object. The signaling device includes at least two vertically stacked sections for announcing a status of the monitored person or object with each section announcing a status of a different condition.

Each vertically stacked section includes a solid-state, light-emitting device (LED) that is supported such that when the device is mounted to the wall of the hallway a beam of light from the LED is substantially aimed at a wall opposing the wall to which the device is mounted. A pair of opposing planar surfaces extends along diverging planes and is supported over each LED to receive the LED's beam of light. Each of the planar surfaces extends at an angle approximately equal to a characteristic optical beam angle of the beam of light. This arrangement causes light from the light beam to substantially uniformly illuminate an entirety of each of the planar surfaces when viewed from an angle approximately perpendicular to a direction in which the beam of light is aimed.

Moreover, each of the planar surfaces has an area sufficient to be easily viewed at a location in the hallway remote from where the device is mounted such that one planar surface of the pair is easily seen from one end of the hallway and the other planar surface is easily seen from the other end of the hallway. The signaling device further includes a lens for diffusing light reflected from the planar surfaces.

DETAILED DESCRIPTION OF THE INVENTION

Figure 1:
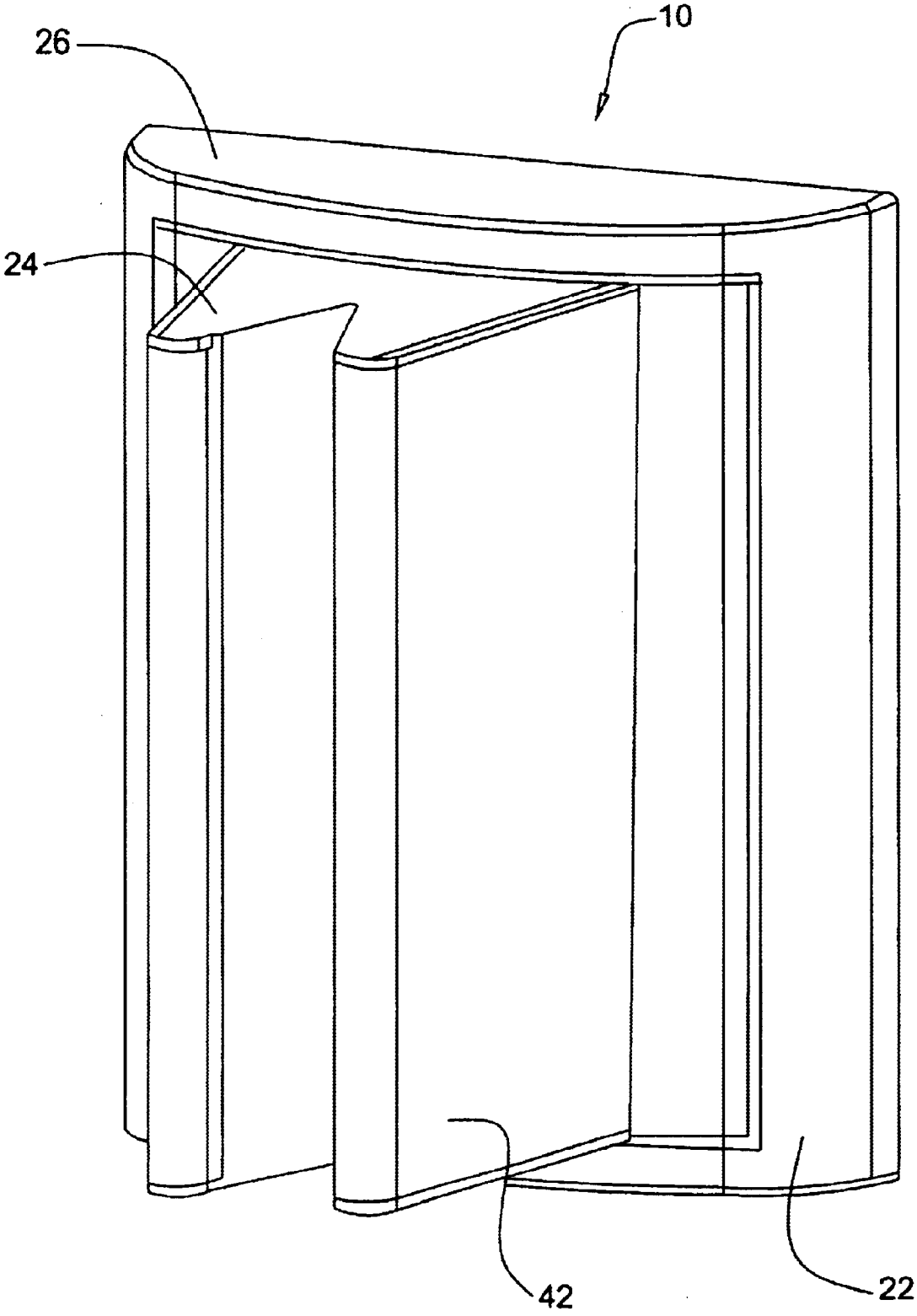
FIG. 1. is a perspective view of an illustrative signaling device constructed in accordance with the teachings of the present invention.
Figure 8:
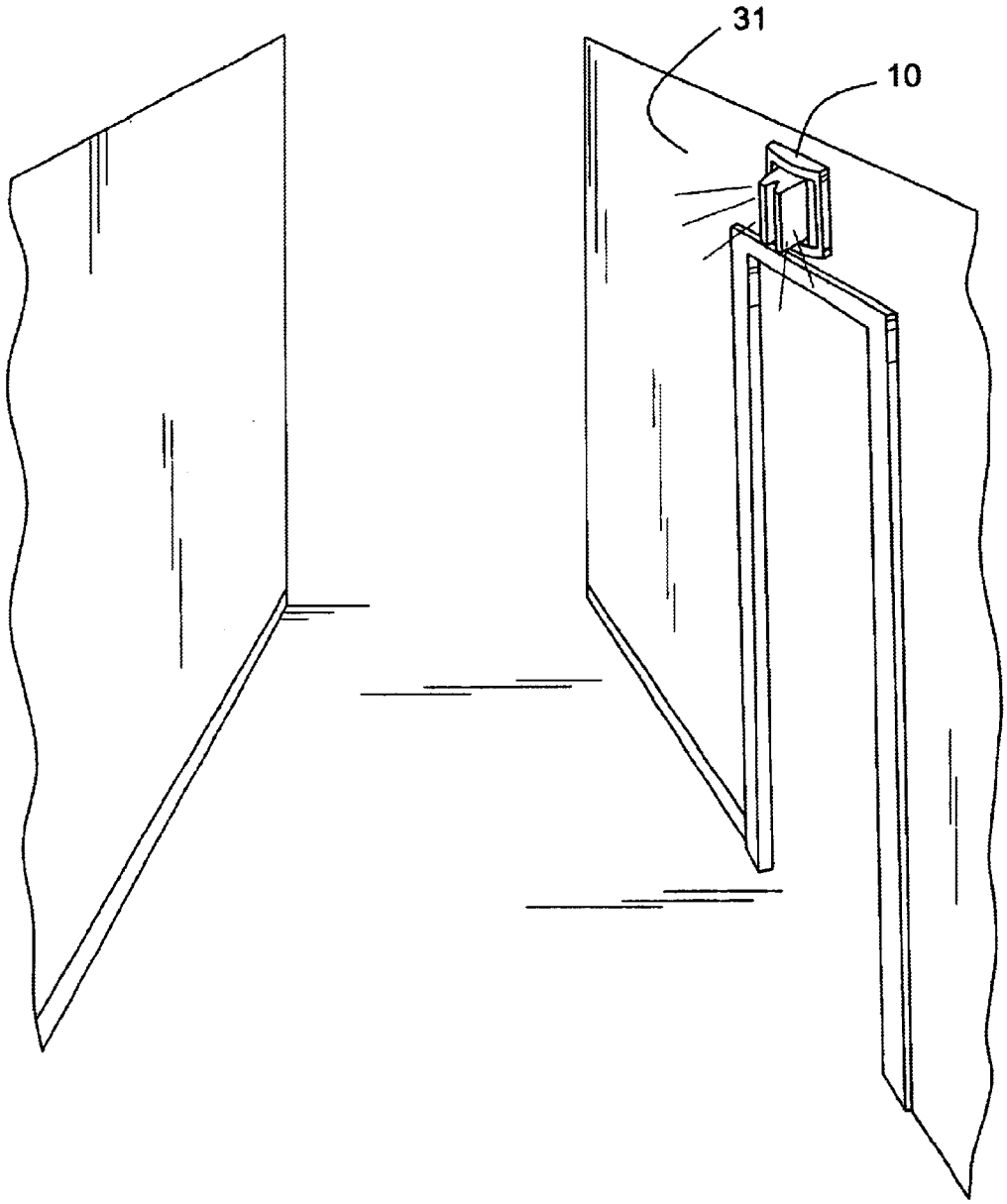
FIG. 8 is perspective view showing the signaling device of FIG. 1 mounted in a corridor.

Referring now to FIG. 1 of the drawings, there is shown an illustrative embodiment of a signaling device, in this case a corridor light 10, constructed in accordance with the teachings of the present invention. The corridor light 10 is adapted to annunciate in the hallway of a building a status of a monitored person or object. Typically, the corridor light 10 will be used in a health care environment such as a hospital, out-patient clinic or assisted living facility to annunciate the status or priority of a call from a patient. In such cases, the corridor light 10 is mounted in the hallway outside a patient room such as shown in FIG. 8 to provide a readily visible signal to the health care staff of the status of a condition of the patient housed in the room. In the health care context, the status annunciated by the corridor light 10 can include any number of different conditions or situations including calls initiated by the monitored patient or signals initiated by the health care staff attending the patient.

To this end, the corridor light 10 is configured to provide different signals each of which represents a status of a different condition, e.g., a call status or a call priority. For example, the corridor light 10 can be equipped with different colored lights and/or lights which flash in different patterns to differentiate between the different calls. The different statuses or call priorities can include a normal nurse call from the patient, a nurse call from a bathroom, a signal representing a staff member in the room and a signal designating an emergency or "code blue" situation. Of course, those skilled in the art will appreciate that the present invention is not limited to providing any particular type of signal or annunciating the status of any particular condition of the monitored person or object.

Figure 10:
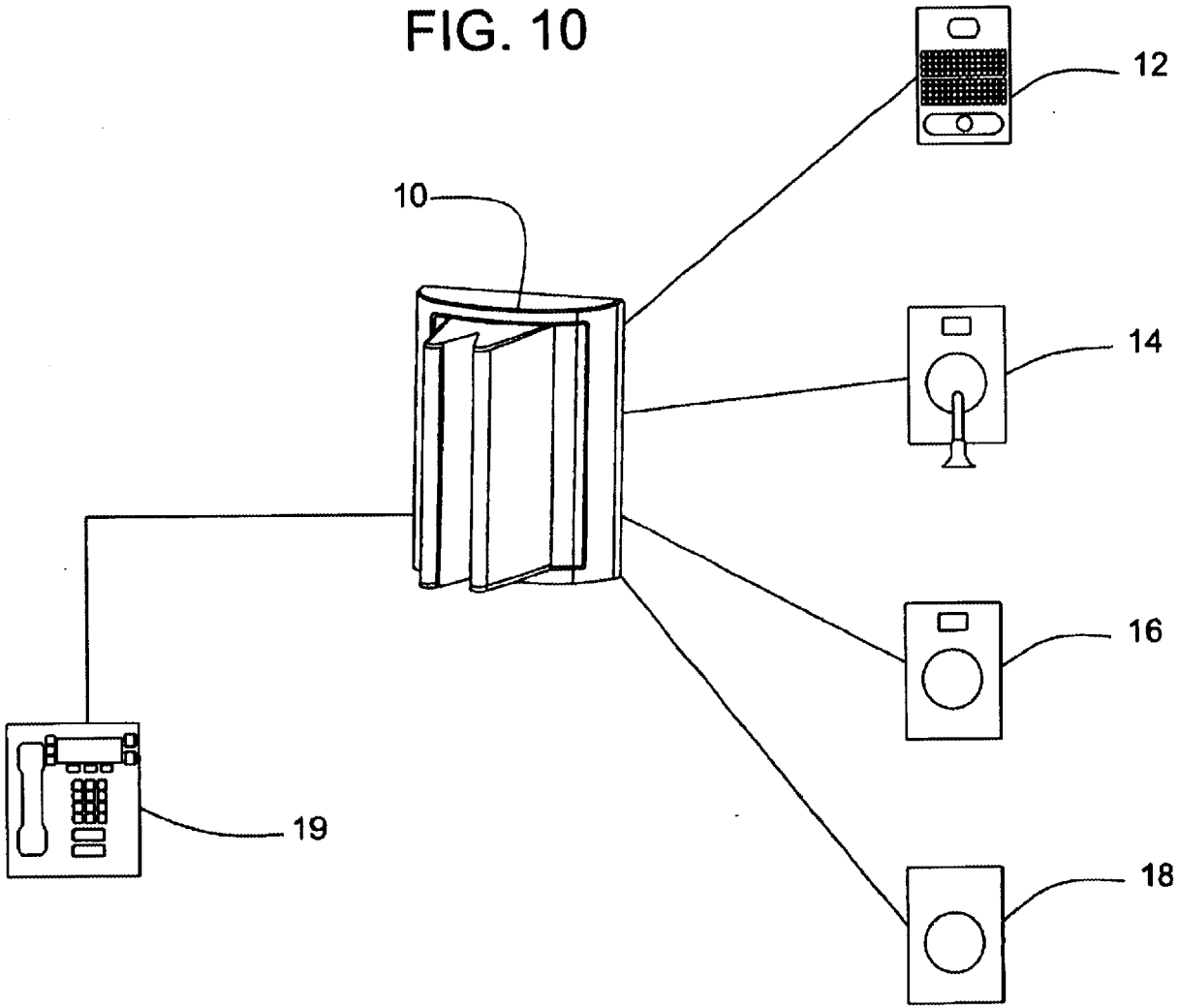
FIG. 10 is a block diagram showing an illustrative communication system employing the signaling device of FIG. 1.

The corridor light 10 is generally just one component of a communication system (such as shown in FIG. 10) which could include a nurse call button or pull chain 12 in the patient room, a nurse call button or pull chain 14 in the patient's bathroom, a staff member actuatable button 16 to indicate staff presence in the room and a staff member actuatable button 18 to signify an emergency "code blue" situation. Upon actuation of, for example, the nurse call button 12 in the patient's room, a signal is sent to the corridor light 10 to actuate a particular signal. In addition to relaying a signal to the corridor light, these call buttons can be configured to signal a central annunciator panel or console panel 19 located, for example, at a nurse station. This central annunciator panel 19 can also be configured to allow for reset of the particular signal being sent to the corridor light.

Figure 2:
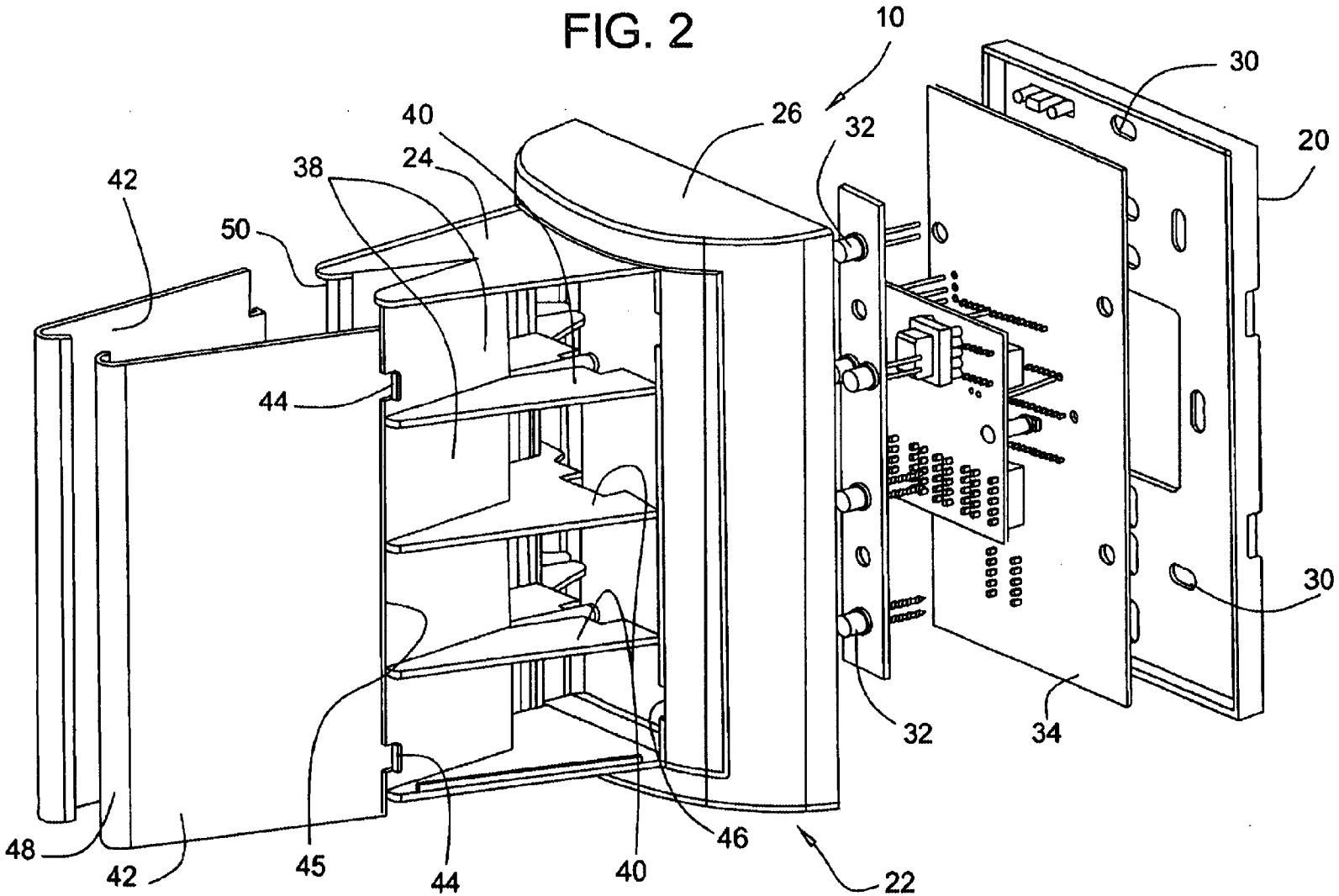
FIG. 2 is an exploded front perspective view of the signaling device of FIG. 1.

In the illustrated embodiment, the corridor light 10 includes a back plate 20 and a housing 22, which includes front and rear portions 24, 26, as shown in FIG. 2. When assembled the back plate 20 engages an open rear face of the rear portion 26 of the housing 22. As explained in greater detail below, the front section 24 of the housing 22 is divided into a plurality of vertically stacked sections 28, with each section 28 being adapted to announce a status of a different condition of the monitored patient or object. In this case, the housing 22 includes four different sections 28 (see, e.g., FIGS, 4 and 5), however, any number of sections could be employed.

For mounting the corridor light 10, the back plate 20 has a plurality of mounting holes 30 therein. As will be appreciated, the corridor light can be mounted on any suitable surface such as a wall 31 in either a corridor or a space outside of a room as shown in FIG. 8. In the context of this application, the term hallway is used to designate any space outside of a room such as a corridor or a larger room or space. Moreover, the term wall is used to designate any mounting surface in the hallway including, for example, a wall, a ceiling or a partition. It will be appreciated that the corridor light 10 could be mounted in any orientation, although typically it will be arranged such that the different sections are arranged vertically.

To provide illumination, each section of the corridor light 10 has an associated solid-state light-emitting device or diode 32 (LED). As will be appreciated, the LEDs are much more reliable than conventional incandescent bulbs and virtually eliminate the maintenance costs associated bulb replacement. This reliability is particularly advantageous in a health care environment. In this instance, the LEDs 32 are supported in the housing on a PC board 34 (see FIGS. 2–4) that is arranged in the rear portion 26 of the housing 22 adjacent the back plate 20. The PC board 34 and, in turn the LEDs 32 are supported in the housing 22 such that the beam of light produced by each LED 32 is aimed outward from the surface on which the corridor light 10 is mounted. A plurality of connectors 36 (see FIG. 3) are provided on a rear face of the PC board 34 for connecting the corridor light 10 to the communication system used in the facility, e.g., the nurse call buttons, console panel, etc. The connectors 36 are accessible through an opening in the back plate 20 of the corridor light 10 as shown in FIG. 2.

To differentiate between the different conditions which are being annunciated by the corridor light 10, the LEDs 32 can be adapted to illuminate in a different color (e.g., amber, red, blue and green) or to provide different blinking signals. Additionally, one or more LEDs 32 can be used for each of the sections 28 to provide the desired illumination. For example, in the illustrated embodiment, the second section from the top (with reference to the drawings) uses two LEDs 32 while each of the other sections has one LED 32. Thus, as used herein LED is meant to include both its singular and plural sense.

Figure 9:
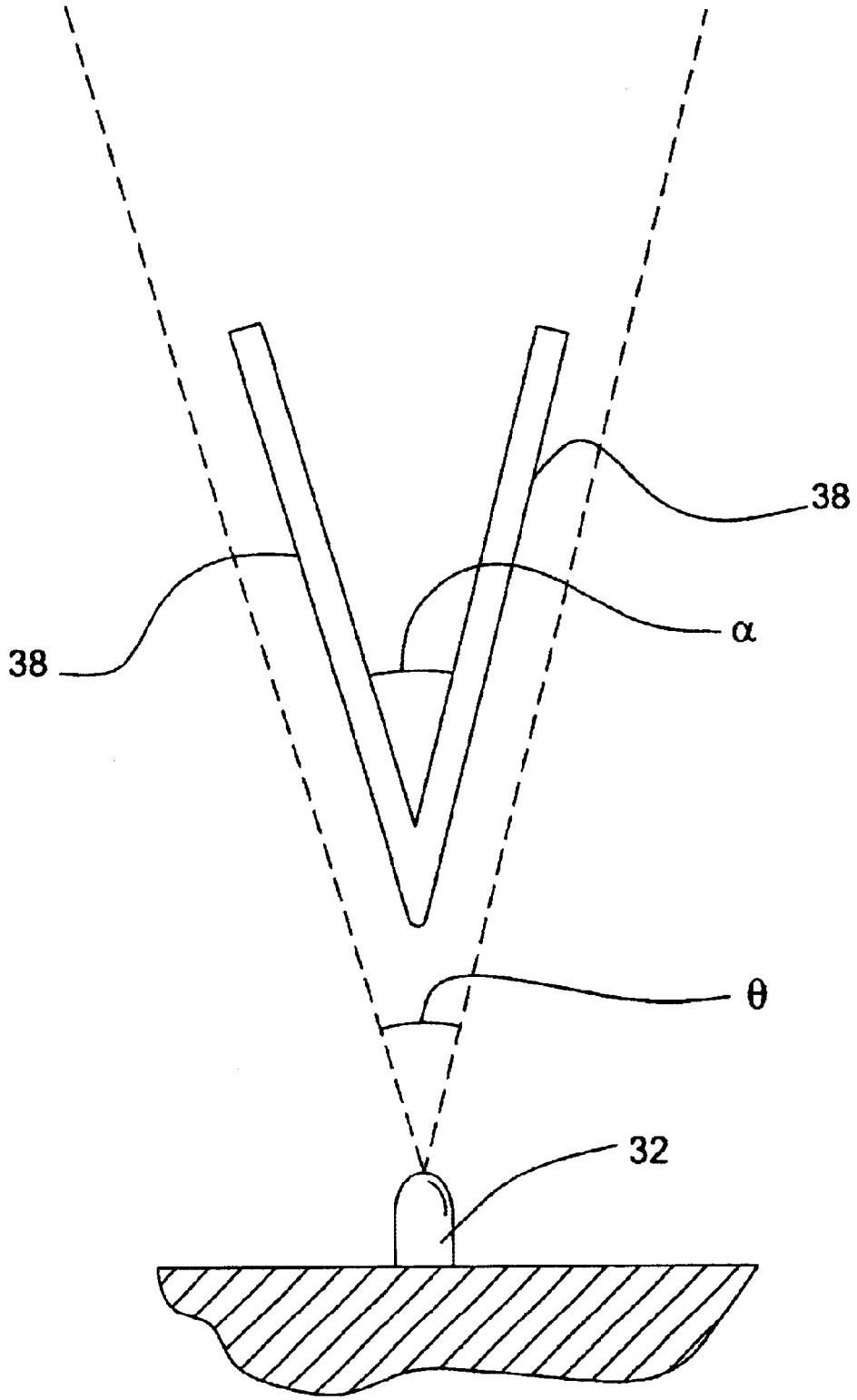
FIG. 9. is a schematic view showing the relationship of a LED and the planar reflector surfaces of the signaling device of FIG. 1.

Each LED 32 produces a beam of light having a characteristic optical beam or viewing angle θ (i.e., the off-axis angle where the luminous intensity is ½ the peak intensity, see FIG. 9). Preferably, the beam of light produced by each of the LEDs 32 has a characteristic viewing angle θ of approximately 35° or less. In the illustrated embodiment, the viewing angle θ of the LEDs 32 is 30°. One example of a LED 32 that can be used in the present system is a AlInGaP II LED available from Agilent Technologies (Part Nos. HLMP-EL31, HLMP-ED31, HLMP-CB30/31, HLMP-CM30/31).

Figure 4:
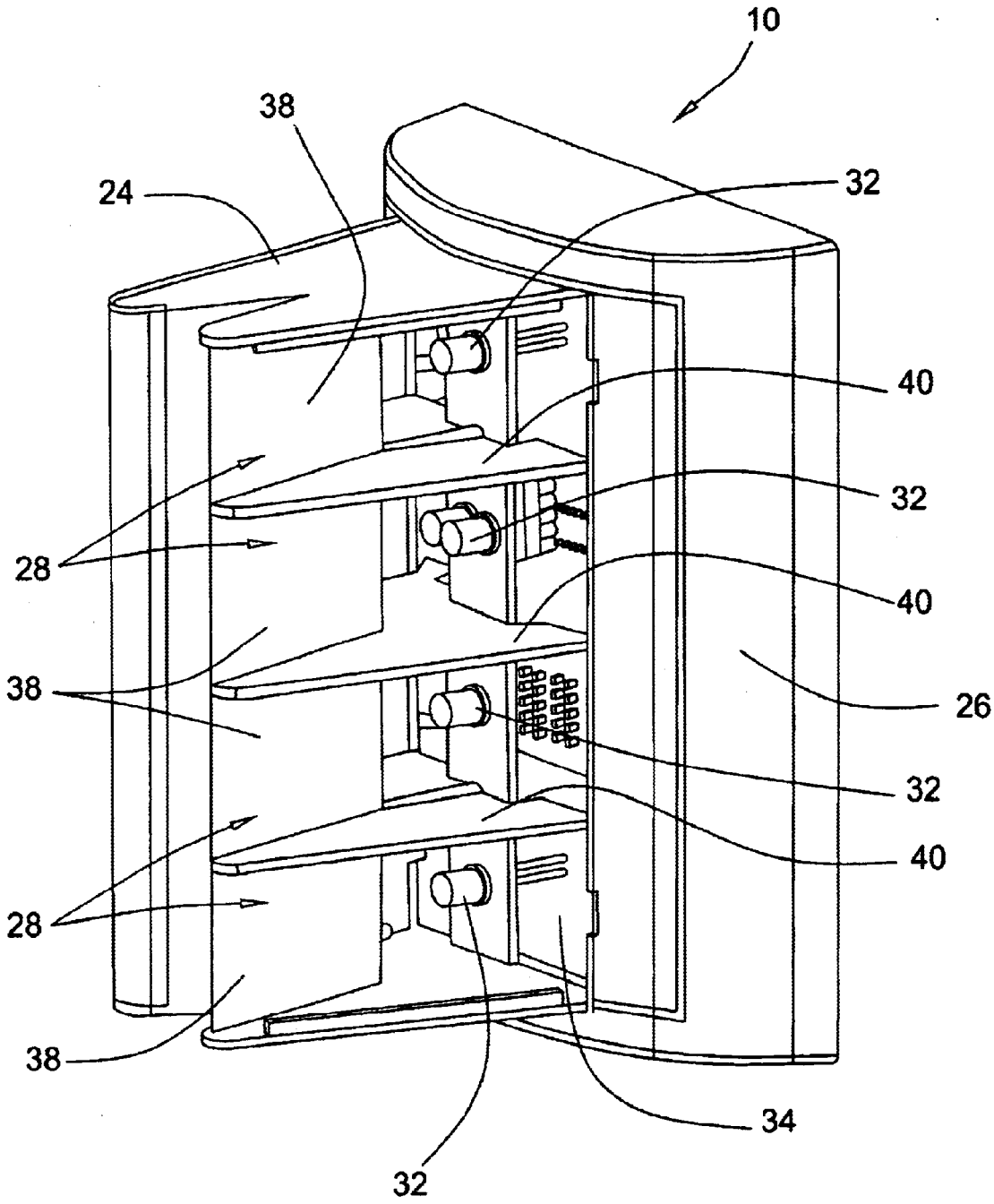
FIG. 4 is a front perspective view of the signaling device of FIG. 1 with one lens removed.
Figure 5:
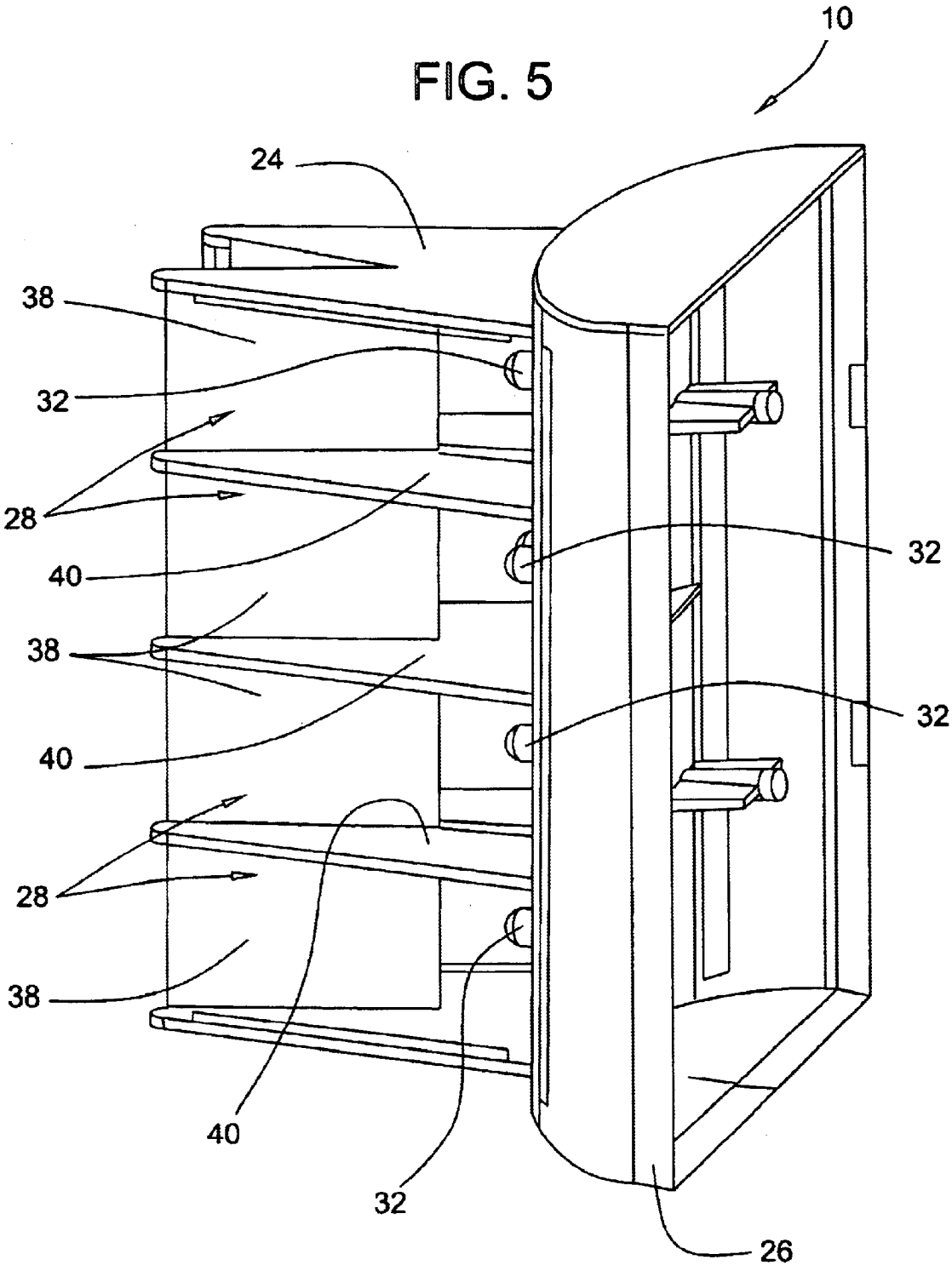
FIG. 5 is a rear perspective view of the signaling device of FIG. 1 with one lens, the back plate and the PCB removed.
Figure 6:
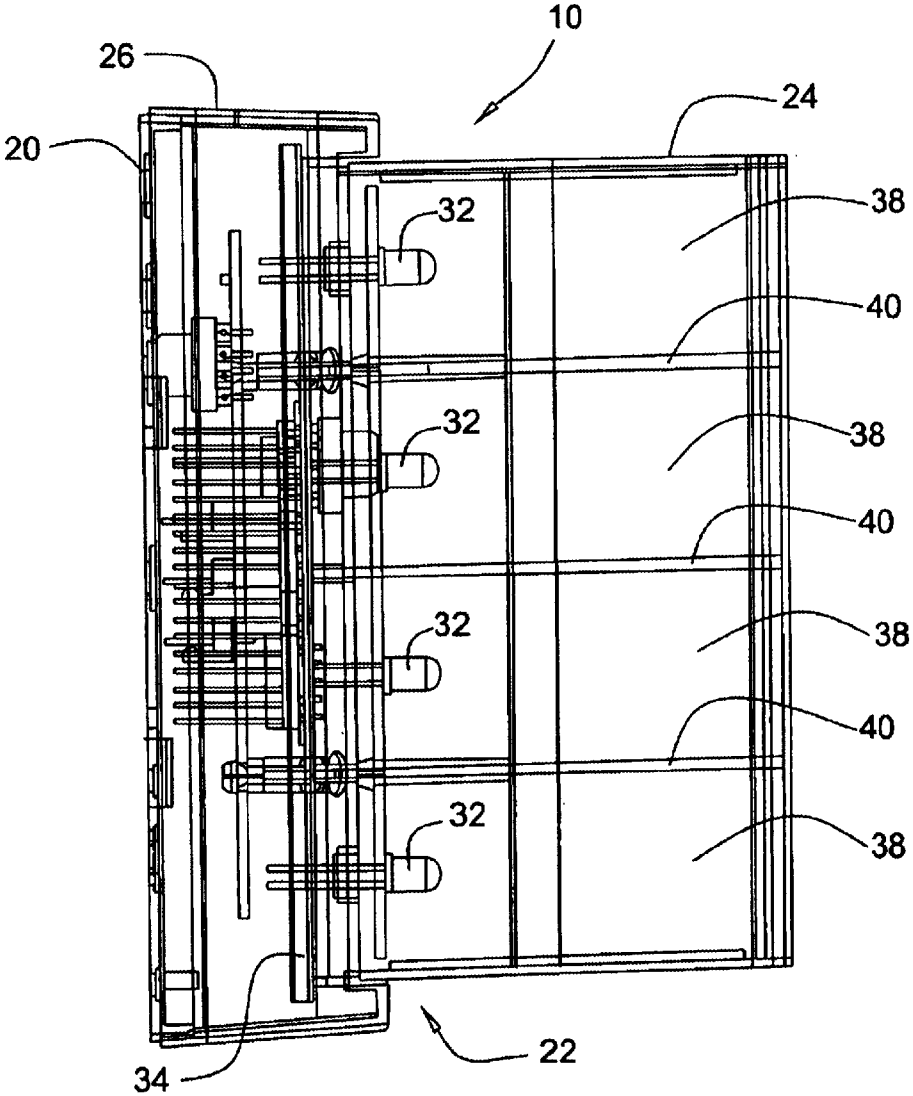
FIG. 6 is a side sectional view of the signaling device of FIG. 1.
Figure 7:
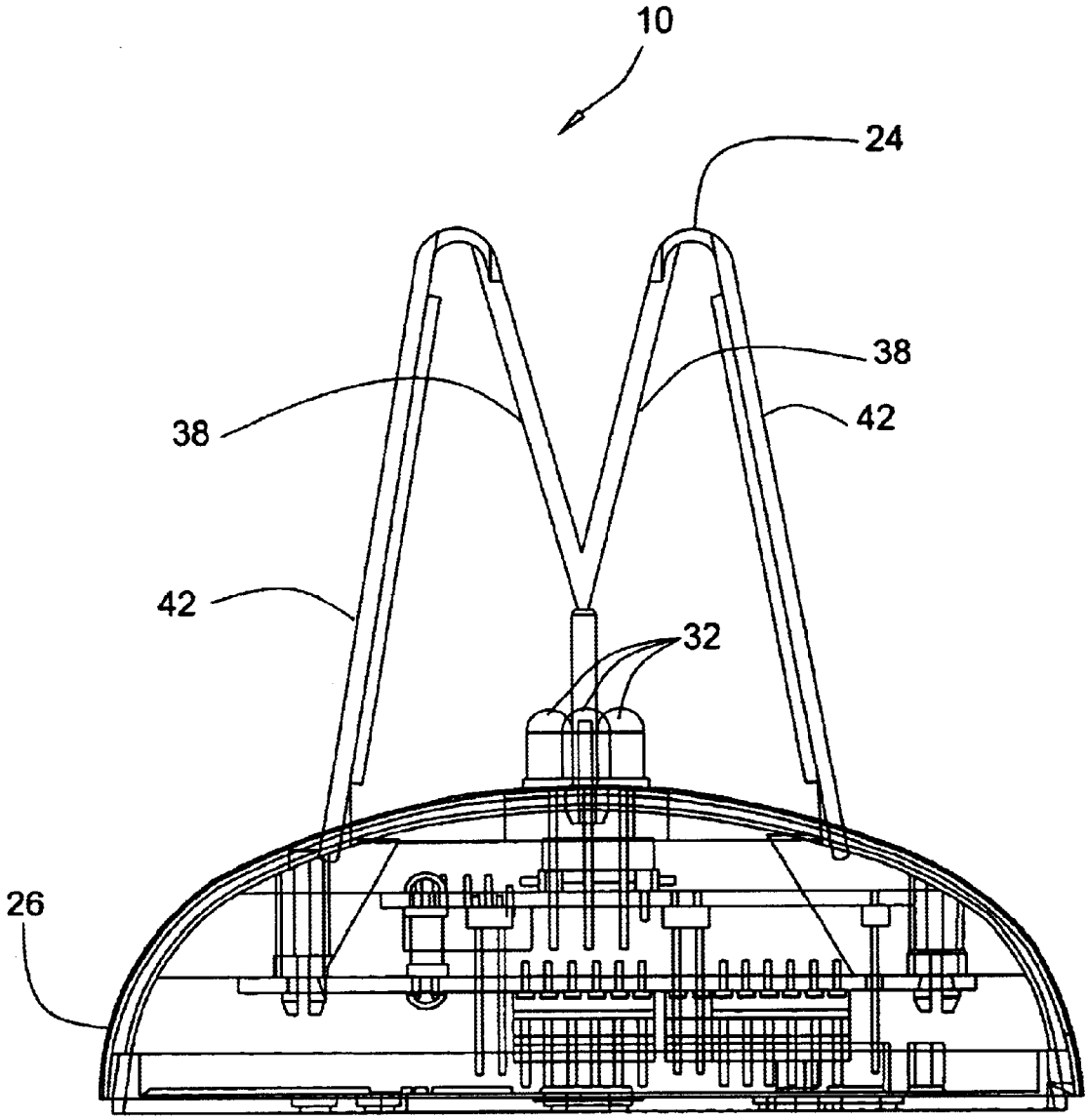
FIG. 7 is a top sectional view of the signaling device of FIG. 1.

For reflecting and dispersing the light produced by the corresponding LED 32, each section 28 has a corresponding pair of reflectors 38 comprising opposing planar surfaces supported over and spaced from the LED 32 to receive the LED's beam of light. As best shown in FIGS. 2 and 7, the planar reflector surfaces 38 are supported in the front portion 24 of the housing 22 such that they extend along diverging planes. In particular, the two planar reflector surfaces 38 are arranged at an angle a relative to each other that is approximately equal to the characteristic viewing angle θ of the LED 32 and with the corner defined by the two reflector surfaces 38 lying substantially on the optical axis of the LED 32. With this arrangement, the planar reflector surfaces 38 are contained within the LED's beam of light and extend approximately parallel to the lines representing the edges of the viewing angle θ of the beam (i.e., the lines where the luminous intensity is ½ the peak intensity) as shown in FIG. 9. If two LEDs 32 are used for a particular section 28, the corner defined by the corresponding pair of reflector surfaces 38 is centered between the two LEDs 32. The planar reflector surfaces 38 for each section 28 are separated from the adjacent section by longitudinally extending (with respect to the beam of light) dividers 40 as shown in FIGS. 4 and 5. In this case, the front portion 24 of the housing 26 has a characteristic V-shaped cutout that extends downward along the entire front end of the front portion of the housing (best seen in FIGS. 1 and 7) as a result of the support of the planar reflector surfaces 38. Of course, it will be understood that the housing 22 does not need to employ this particular configuration in order to support the reflector surfaces 38.

As a result of the arrangement of the planar reflector surfaces 38 relative to the LED 32, the LED 32 substantially illuminates the entirety of each of the planar surfaces 38 when viewed from an angle perpendicular to the direction in which the beam of light is aimed. Moreover, the particular angle a used ensures that a substantially even dispersal of light is achieved on the reflector planar surfaces 38. If the planar reflector surfaces 38 are arranged at an angle a substantially greater than the viewing angle θ of the beam, undesired hot or bright spots will be present on the reflector surfaces when the LED is actuated. The planar reflector surfaces 38 can also have a finish which optimizes even illumination of the light produced by the LED 32. In particular, the planar reflector surfaces 38 can have a polished surface that still produces some dispersal of the light. This dispersal of the light helps ensure substantially even illumination of the surfaces. However, if too reflective a surface is used, undesired bright or hot spots will again be produced. Advantageously, in a preferred embodiment, the planar reflector surfaces 38 can be made of a relatively low cost standard white plastic material made in a mold with a surface designed to produce a high degree of visibility.

The planar reflector surfaces 38 are also sized and spaced from the LED 32 to achieve visibility of the corridor light 10 from a desired distance (e.g., 50–75 feet) in the hallway in which it is mounted. In a health care institutional environment, visibility from relatively long distances, such as at least the ends of the hallway in which the corridor light 10 is mounted, helps ensure that a call from a patient or other signal generates a quick response from the medical staff. The size and spacing of the reflector planar surfaces 38 from the LED 32 also helps ensure that the bulk of the light emitted by the LED 32 bathes the planar reflector surfaces 38 and that they are illuminated evenly. If the planar reflector surfaces 38 are too long for the particular LED 32 used, there will be more light at the end of the reflector surface closest the LED than at the other end of the reflector. A similar problem occurs if the planar reflector surfaces 38 are arranged too close to the LED 32. This unevenness in the illumination of the planar reflector surfaces 38 can adversely impact the visibility of the corridor light 10 from greater distances.

Figure 3:
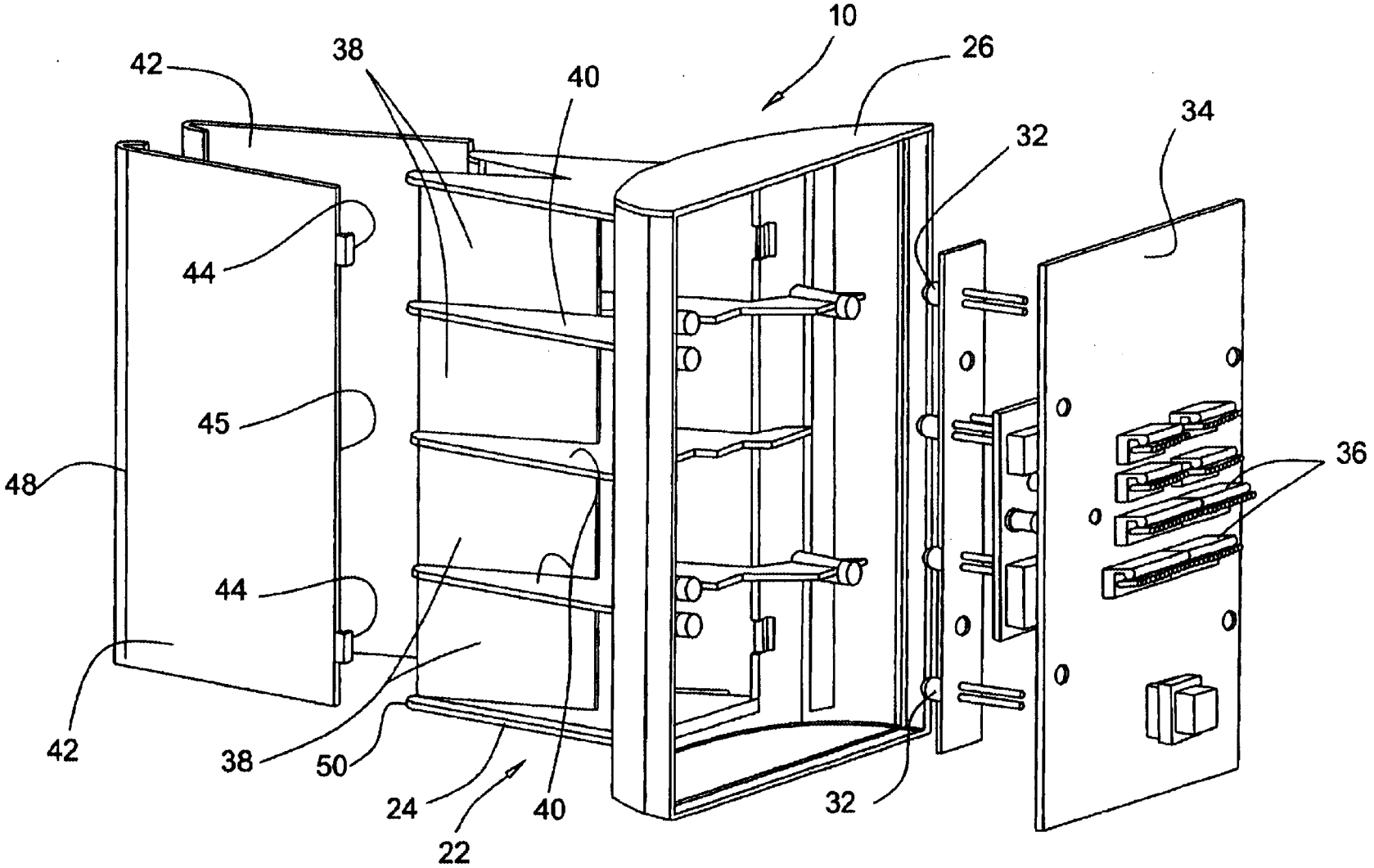
FIG. 3 is an exploded rear perspective view of the signaling device of FIG. 1 with the back plate removed.

To further enhance the visibility of the illuminated planar reflector surfaces 38, the corridor light 10 can include at least one lens 42. In the illustrated embodiment, the corridor light 10 includes a pair of lenses 42 each of which is mountable to an opposing side of the front portion 24 of the housing 22, as best shown in FIGS. 2 and 3. To facilitate snap-fit mounting of the lenses 42, each lens 42 includes a pair of tabs 44 on a rear edge 45 of the lens which are receivable in complementary recesses 46 provided on the housing 22. In addition, the front edge 48 of the lens 42 has a curved configuration that fits over a complimentarily curved surface on the front portion 24 of the housing 22.

To further diffuse the light produced by the illumination of the reflector surfaces 38, each lens 42 can have a textured or translucent surface including a grain or other finish that diffuses light only in the direction of that beam of light is directed. For example, the lens 42 could have a grain which runs between the rear and front edges 45, 48 of the lens 42. Like with the planar reflector surfaces 38, the desired optical effect can be achieved using a relatively low cost standard part such as a clear plastic material having a textured matte surface which runs between the front and rear edges of the lens.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A signaling device for annunciating in a hallway of a building a status of a monitored person or object, the signaling device comprising:

at least two vertically stacked sections for announcing a status of the monitored person or object, each section announcing a status of a different condition and each section comprising:

(1) a solid-state, light-emitting device (LED) supported such that when the device is mounted to the wall of the hallway a beam of light from the LED is substantially aimed at a wall opposing the wall to which the device is mounted;

(2) a pair of opposing planar surfaces extending along diverging planes and supported over the LED to receive the LED's beam of light such that each of the planar surfaces extends at an angle approximately equal to a characteristic optical beam angle of the beam of light, thereby causing light from the light beam to substantially illuminate an entirety of each of the planar surfaces when viewed from an angle approximately perpendicular to a direction in which the beam of light is aimed; and (3) each of the planar surfaces having an area sufficient to be easily viewed at a location in the hallway remote from where the device is mounted; and a lens for diffusing light reflected from the planar surfaces.

2. The signaling device of claim 1 wherein the lens has a finish including a grain which runs in the same direction as the beam of light produced by the LEDs.

3. The signaling device of claim 1 wherein the lens comprises a translucent plastic material.

4. The signaling device of claim 1 wherein the adjacent pairs of vertically stacked sections are separated by a divider.

5. The signaling device of claim 1 wherein the LED of each vertically stacked section produces a differently colored beam of light.

6. The signaling device of claim 1 wherein the pair of opposing planar surfaces for each section are arranged in a V-shape.

7. The signaling device of claim 6 wherein the pair of opposing planar surfaces for each section is arranged in spaced relation from the corresponding LED.

8. The signaling device of claim 7 wherein the pair of opposing planar surfaces for each section define a corner that is arranged substantially on an optical beam axis of the LED.

9. The annunciating system of claim 7 wherein the pair of opposing planar surfaces for each section define a corner that is arranged substantially on an optical beam axis of the LED.

10. The signaling device of claim 1 wherein the pair of opposing planar surfaces for each section have a finish which reflects and disperses the beam of light produced by the LED.

11. The signaling device of claim 1 wherein the pair of opposing planar surfaces for each section comprise a white plastic material.

12. The signaling device of claim 1 wherein the vertically stacked sections are arranged in a housing which is mountable to a wall.

13. A system for annunciating in a hallway of a building a status of a monitored person or object contained within a room, the system comprising:

a first actuatable element arranged in the room;

a second actuatable element arranged in the room; and a signaling device arranged in the hallway, the signaling device including at least two vertically stacked sections for announcing a status of the monitored person or object, each section announcing a status of a respective one of the first and second actuatable elements and each section comprising:

(1) a solid-state, light-emitting device (LED) supported such that when the device is mounted to the wall of the hallway a beam of light from the LED is substantially aimed at a wall opposing the wall to which the device is mounted;

(2) a pair of opposing planar surfaces extending along diverging planes and supported over the LED to receive the LED's beam of light such that each of the planar surfaces extends at an angle approximately equal to a characteristic optical beam angle of the beam of light, thereby causing light from the light beam to substantially illuminate an entirety of each of the planar surfaces when viewed from an angle approximately perpendicular to a direction in which the beam of light is aimed; and (3) each of the planar surfaces having an area sufficient to be easily viewed at a location in the hallway remote from where the device is mounted; and a lens for diffusing light reflected from the planar surfaces.

14. The annunciating system of claim 13 wherein the first actuatable element is a nurse call element.

15. The annunciating system of claim 14 wherein the second actuatable element is a staff present element for signifying presence of a staff member in the room.

16. The annunciating system of claim 14 wherein the second actuatable element is a second nurse call element that is arranged remote from the first nurse call element.

17. The annunciating system of claim 13 wherein the lens has a finish including a grain which runs in the same direction as the beam of light produced by the LEDs.

18. The annunciating system of claim 13 wherein the LED of each vertically stacked section produces a differently colored beam of light.

19. The annunciating system of claim 13 wherein the pair of opposing planar surfaces for each section are arranged in a V-shape.

20. The annunciating system of claim 19 wherein the pair of opposing planar surfaces for each section is arranged in spaced relation from the corresponding LED.

21.The annunciating system of claim 13 wherein the pair of opposing planar surfaces for each section have a finish which reflects and disperses the beam of light produced by the LED.

* * * * *